US007542061B2

(12) United States Patent
Han

(10) Patent No.: US 7,542,061 B2
(45) Date of Patent: Jun. 2, 2009

(54) THERMAL IMAGE FORMING APPARATUS

(75) Inventor: Dong-hun Han, Suwon-si (KR)

(73) Assignee: Samsung Electronics Co., Ltd., Gyeonggi-do, Suwon-si (KR)

( * ) Notice: Subject to any disclaimer, the term of this patent is extended or adjusted under 35 U.S.C. 154(b) by 222 days.

(21) Appl. No.: 11/449,682

(22) Filed: Jun. 9, 2006

(65) Prior Publication Data

US 2006/0280540 A1 Dec. 14, 2006

(30) Foreign Application Priority Data

Jun. 10, 2005 (KR) ..... 10-2005-0049698

(51) Int. Cl.
*B41J 2/335* (2006.01)

(52) U.S. Cl. ..... 347/200

(58) Field of Classification Search ..... 347/200, 347/201, 209, 210

See application file for complete search history.

(56) References Cited

U.S. PATENT DOCUMENTS 5,485,192 A 1/1996 Nagahata
5,791,793 A 8/1998 Nagahata
6,236,422 B1 5/2001 Nagahata
7,179,002 B2 * 2/2007 Lee et al. ..... 400/120.17

FOREIGN PATENT DOCUMENTS

| | | |
|---|---|---|
| JP | 05-050634 | 3/1993 |
| JP | 07-148961 | 6/1995 |
| JP | 08-258309 | 10/1996 |
| JP | 11-216893 | 8/1999 |

* cited by examiner

*Primary Examiner*—Huan H Tran
(74) *Attorney, Agent, or Firm*—Roylance, Abrams, Berdo & Goodman, L.L.P.

(57) ABSTRACT

A thermal image forming apparatus includes a platen roller and a thermal printhead. A heating portion of the thermal printhead has a plurality of heating elements arranged along an area where the platen roller and the thermal printhead form a printing nip. A plurality of driving integrated circuits are mounted on a substrate and connected to the heating elements of the heating portion. A block is formed higher than the driving integrated circuits such that the driving integrated circuits are disposed between the block and the heating portion. A conveying unit is disposed toward the heating portion of the thermal printhead and conveys a sheet of paper between the platen roller and the thermal printhead.

18 Claims, 7 Drawing Sheets

THERMAL IMAGE FORMING APPARATUS

CROSS-REFERENCE TO RELATED PATENT APPLICATIONS

This application claims the benefit under 35 U.S.C § 119(a) of Korean Patent Application No. 10-2005-0049698, filed on Jun. 10, 2005, in the Korean Intellectual Property Office, the entire disclosure of which is hereby incorporated by reference.

BACKGROUND OF THE INVENTION

1. Field of the Invention

The present invention relates to a thermal image forming apparatus including a thermal printhead to form an image on a sheet of paper.

2. Description of the Related Art

FIG. 1 illustrates a part of a conventional thermal image forming apparatus 10.

Referring to FIG. 1, the thermal image forming apparatus 10 includes a thermal printhead 12 that applies heat to a sheet of paper P while contacting a platen roller 11 and forming a printing nip between the thermal printhead 12 and the platen roller 11. A conveying unit 16 conveys the paper P between the platen roller 11 and the thermal printhead 12. The conveying unit 16 includes two rollers that are rotatably engaged with each other. The thermal printhead includes a plurality of heating elements arranged along an area forming the printing nip. An image is formed on the paper P by the heating elements that are selectively heated by a driving integrated circuit 13 while the paper P passes through the printing nip between the platen roller 11 and the thermal printhead 12. The driving integrated circuit 13 drives the heating elements, and consequently a great amount of heat is generated in the driving integrated circuit 13. Because the driving integrated circuit 13 is disposed toward the paper P supplied between the platen roller 11 and the thermal printhead 12, the heat generated in the driving integrated circuit 13 may be unnecessarily transferred to the paper P through a molding portion 14. When the paper P is not general paper but thermal paper, image deterioration may occur such as vertical bending in which lines are formed on the paper P along the conveying direction of the paper P. To prevent this problem, a cover member 15 is installed to cover the driving integrated circuit 13. The cover member 15 prevents the driving integrated circuit 13 from contacting the paper P and interrupts the heat transfer from the driving integrated circuit 13 to the paper P.

However, in the conventional thermal image forming apparatus, when the paper P is supplied between the platen roller 11 and the thermal printhead 12, which are separated from each other before an image is printed, the leading edge of the paper P can bump against a portion where the cover member 15 and the thermal printhead 12 are connected to each other. Thus, paper conveyance is interrupted, which can cause a paper jam. As illustrated in FIG. 1, the paper jam can occur in a structure in which a conveyance position 'A' of the paper P passing the conveying unit 16 is not horizontal to a position 'B' of the printing nip formed between the platen roller 11 and the thermal printhead 12, that is, the paper P passing the conveying unit 16 is not horizontally conveyed to the printing nip.

Accordingly, a need exists for a thermal image forming apparatus having improved paper conveyance between a thermal printhead and a platen roller.

SUMMARY OF THE INVENTION

The present invention provides a thermal image forming apparatus in which a sheet of paper may be conveyed between a thermal printhead and a platen roller without interruption and contact between the paper and a driving integrated circuit is prevented even when the conveyance position of the paper passing through the conveying unit is not horizontal to a position of a printing nip formed between the platen roller and the thermal printhead.

According to an aspect of the present invention, a thermal image forming apparatus includes a platen roller, and a thermal printhead. A heating portion of the thermal printhead has a plurality of heating elements that are arranged along an area where the platen roller and the thermal printhead form a printing nip. A plurality of driving integrated circuits are mounted on a substrate disposed on a side of the heating portion and connected to the heating elements of the heating portion. A block is formed to be higher than the driving integrated circuits and to face the heating portion across the driving integrated circuits. A conveying unit is disposed toward the heating portion of the thermal printhead and conveys a sheet of paper between the platen roller and the thermal printhead.

An incline that slants in a conveying direction of the paper may be formed on a side of the block facing the driving integrated circuits.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 2:
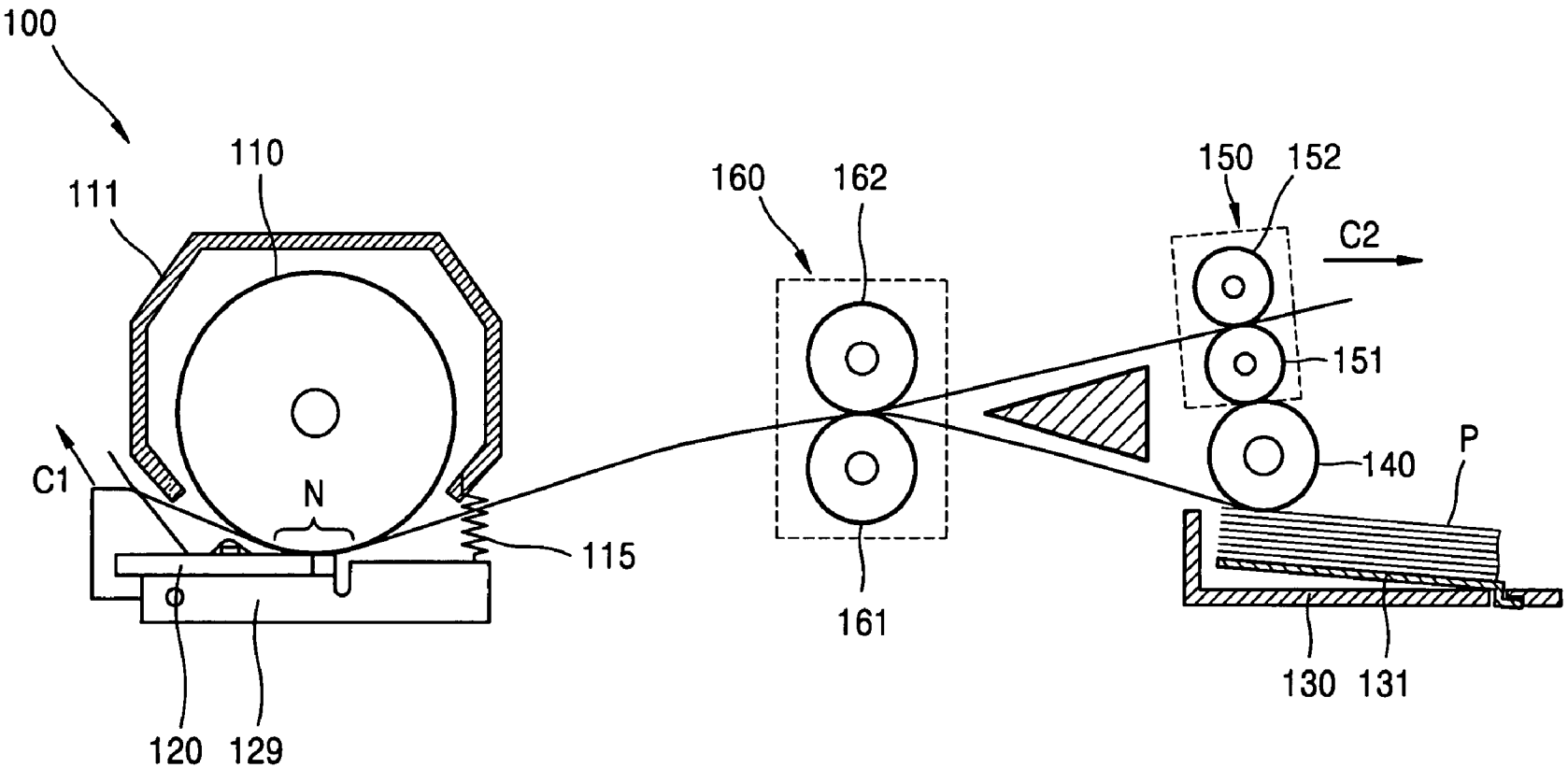
FIGS. 2 and 3 are schematic diagrams illustrating a thermal image forming apparatus according to an exemplary embodiment of the present invention.
Figure 3:
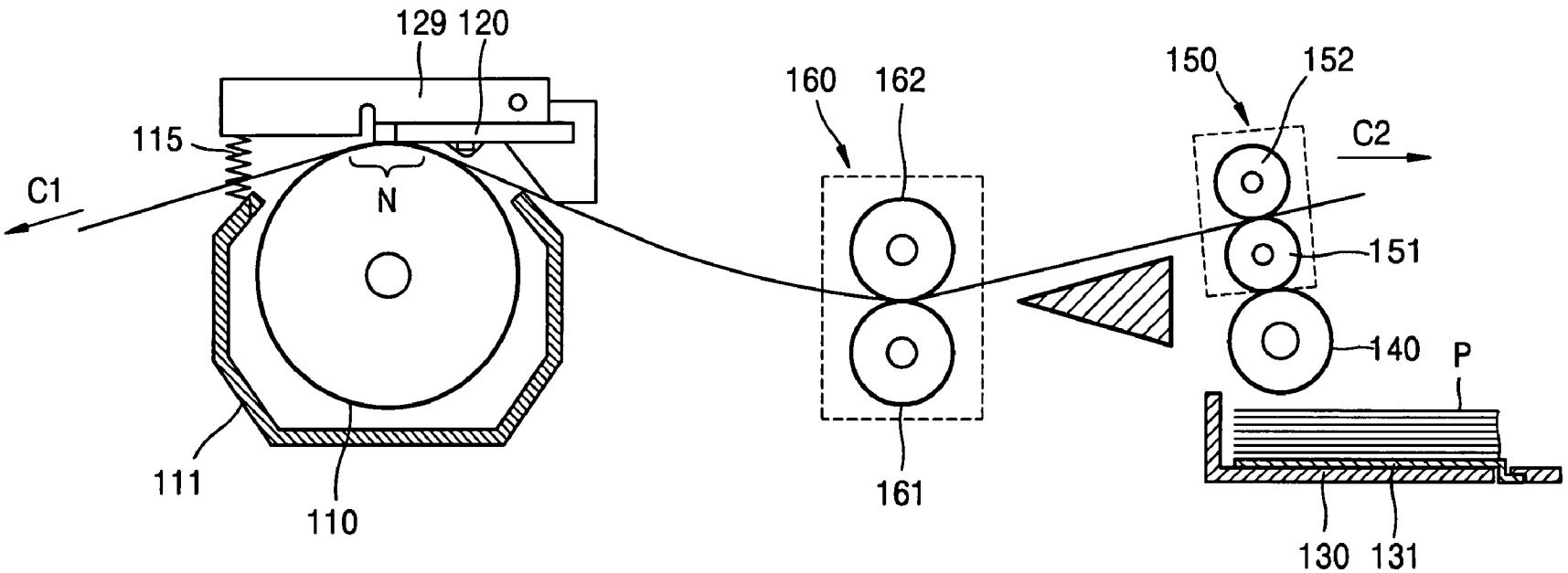

FIGS. 2 and 3 are schematic diagrams illustrating a thermal image forming apparatus 100 according to an exemplary embodiment of the present invention.

Referring to FIGS. 2 and 3, the image forming apparatus 100 includes a platen roller 110 and a thermal printhead 120. The platen roller 110 forms a printing nip N by contacting the thermal printhead 120 with a predetermined pressure. The thermal printhead is pivotally installed, and is elastically biased toward a contact direction by an elastic member 115. The elastic member 115 may be a tension spring of which a first end is connected to a holder 129 supporting the thermal printhead 120 and a second end is connected to a frame 111 enclosing a part of the platen roller 110. The thermal printhead 120 contacting the platen roller 110 may be separated from the platen roller 110 to prevent damage to a sheet of paper P when the paper P is supplied between the thermal printhead 120 and the platen roller 110. A pivot member (not shown) may be provided to separate the thermal printhead 120 from the platen roller 110.

A paper feed cassette 130 is installed at a side of the thermal printhead 120. A knock-up plate 131 is rotatably installed in the paper feed cassette 130, and the paper P is stacked in the knock-up plate 131. A pickup roller 140 that picks up the paper P is installed above the knock-up plate 131. The knock-up plate 131 is raised to a pickup position where the paper P stacked in the knock-up plate 131 contacts the pickup roller 140 and is moved downwardly to a standby position where the knock-up plate 131 is separated from the pickup roller 140. A discharge unit 150 is installed on the pickup roller 140 to discharge the paper P. The discharge unit 150 may include a discharge roller 151 rotatably engaged with the pickup roller 140, and an idle roller 152 rotatably engaged with the discharge roller 151. A conveying unit 160 is installed between the pickup roller 140 and the platen roller 110. The conveying unit 160 moves the paper P in a first direction C1 and a second direction C2. The conveying unit 160 may include a conveying roller 161, and an idle roller 162 rotatably engaged with the conveying roller 161. The conveying roller 160 may be driven by a driving member, which is not shown, such as a motor rotating clockwise and counterclockwise.

The thermal printhead 120 may perform duplex printing as well as single-sided printing. The thermal printhead 120 may be moved between a first position where the thermal printhead 120 contacts one side of the paper P, as illustrated in FIG. 2, and a second position where the thermal printhead 120 contacts the other side of the paper P, as illustrated in FIG. 3. The paper P on which the duplex printing is performed by the thermal printhead 120 is a thermal paper sheet including a base sheet, and on each side of which a predetermined color ink layer is formed. Each ink layer may be formed as a single layer to represent a single color or a multiple layer to represent two or more colors. For example, an ink layer on one side of the base sheet may be formed as two layers to represent yellow and magenta colors, and an ink layer on the other side of the base sheet may be formed as a single layer to represent a cyan color. In this case, if the base sheet is made of a transparent material, an image of yellow and magenta colors is formed on one side of the base sheet and an image of a cyan color is formed on the other side. The yellow, magenta, and cyan colors are displayed in an overlapping manner, such that a color image is formed. When the base sheet is made of an opaque material and the same color ink layer is formed on each side of the base sheet, different images may be formed on each side of the base sheet. The paper P may be manufactured using any suitable method, and is not limited to the above described method.

Figure 4:
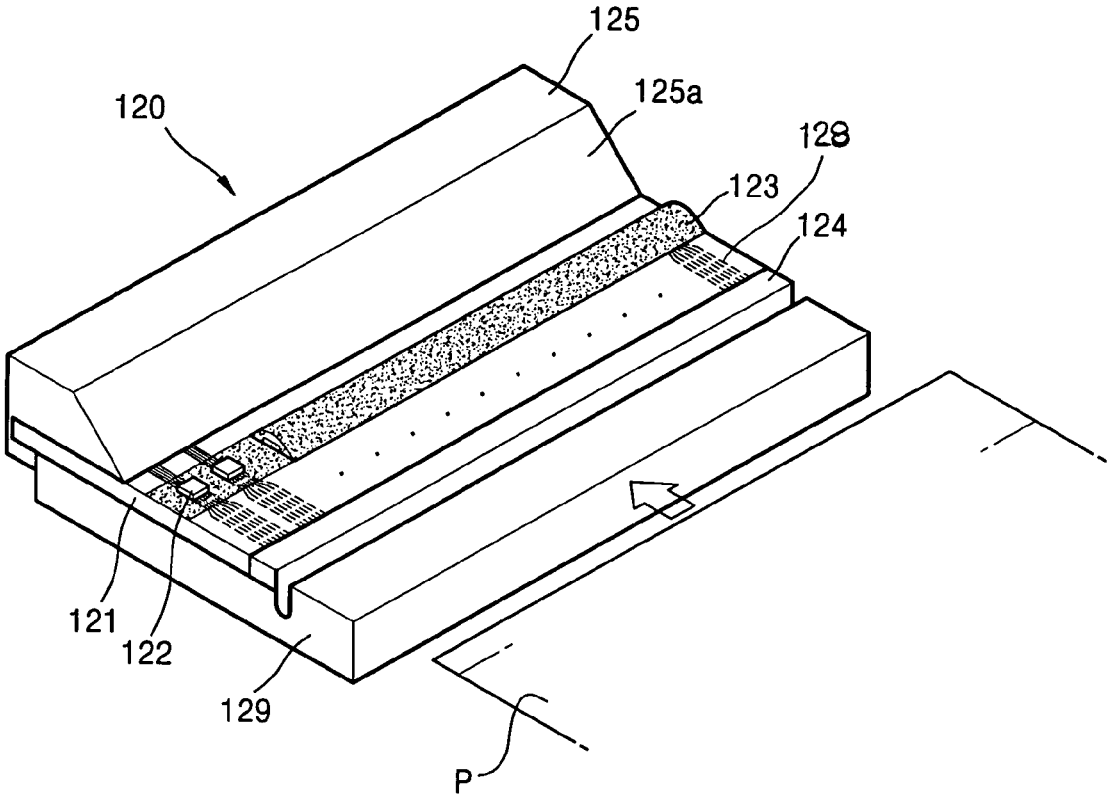
FIG. 4 is a perspective view of a thermal printhead including a block of FIGS. 2 and 3 according to an exemplary embodiment of the present invention.

As illustrated in FIG. 4, the thermal printhead 120 includes a substrate 121, a plurality of driving integrated circuits 122 mounted on the substrate 121, and a heating portion 124 connected to the driving integrated circuits 122. The heating portion 124 includes heating elements 128. The heating elements are arranged along an area where the thermal printhead 120 and the platen roller 110 form the printing nip N (referring to FIGS. 2 and 3), and are individually turned on and off by the driving integrated circuits 122. The heating elements are disposed at predetermined intervals, and several heating elements are connected to each driving integrated circuit 122. When the paper P is passing through the printing nip N between the platen roller 110 and the thermal printhead 120, the heating elements are selectively heated by the driving integrated circuits 122, and consequently, an image is formed on the paper P. The driving integrated circuits 122 are arranged to face the platen roller 110, and are arranged at predetermined intervals in the same direction as the direction in which the heating portion 124 extends. The driving integrated circuits 122 are covered with a molding portion 123 to be protected from the outside. The driving integrated circuits 122 are electrically connected to a driving portion (not shown), and provided with image data. The holder 129 is connected to a side of the thermal printhead 120 that contacts the platen roller 110 and supports the thermal printhead 120. The holder acts as a heat sink that discharges heat generated by the thermal printhead 120.

According to an exemplary embodiment of the present invention, a block 125 is formed on the substrate 121 and faces the heating portion 124 across the driving integrated circuits 122. The block 125 may be connected to the substrate 121 by inserting an end of the substrate 121 into the block 125, but is not limited to this connection. The block 125 is formed on the substrate 121 to be higher than the molding portion 123 that covers the driving integrated circuits 122, and a side 125*a* thereof formed toward the driving integrated circuits 122 is inclined. The side 125*a* slants in the conveying direction of the paper P and may slant at an angle such that the paper P is naturally guided over it. The side 125*a* is illustrated as a plane, but may be formed as a curved surface protruding or hollowed.

Figure 5:
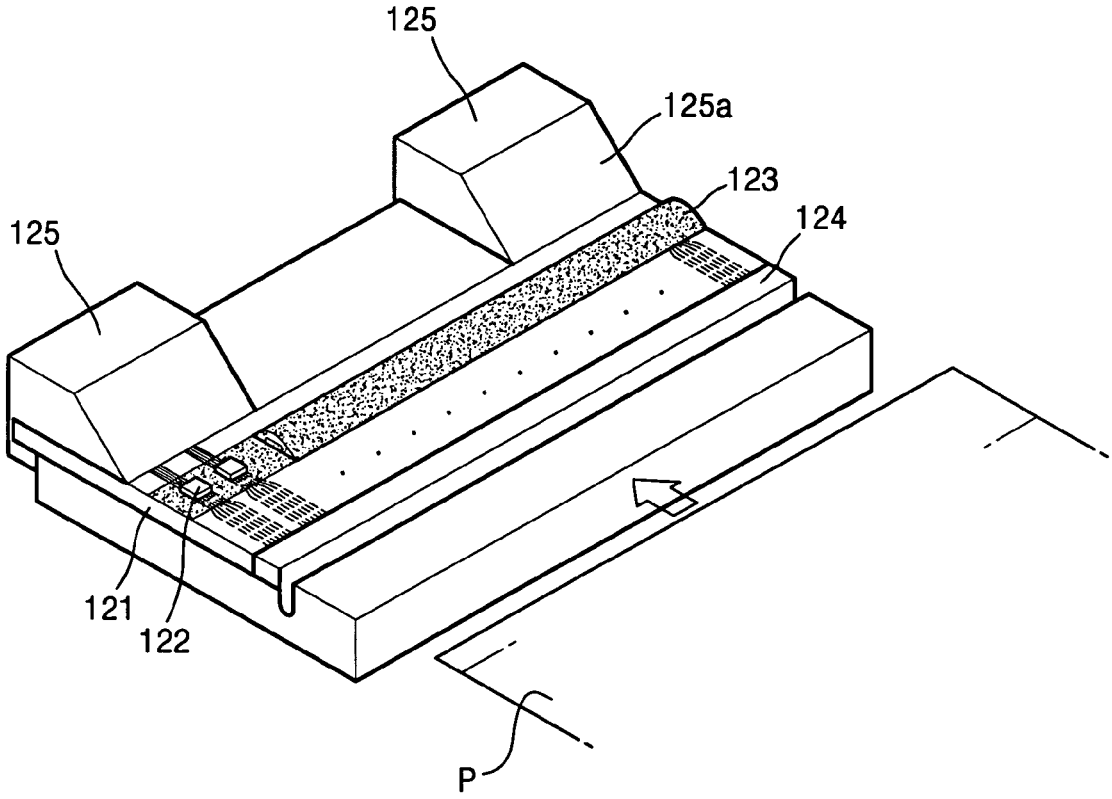
FIG. 5 is a perspective view of a modification of the block of FIG. 4 according to another exemplary embodiment of the present invention.

The block 125 may be continuously formed parallel to the direction in which the driving integrated circuits 122 are arranged, and have a length corresponding to the total length of the arranged driving integrated circuits 122 as illustrated in FIG. 4. Alternatively, the block 125 may be divided into several pieces as illustrated in FIG. 5. Furthermore, the block 125 may be partially formed to correspond to the middle driving integrated circuits 122.

The block 125 guides the conveyance of the paper P when the paper P is conveyed between the thermal printhead 120 and the platen roller 110 that are separated from each other, and enables the paper P to be separated from the driving integrated circuits 122 at a predetermined distance while an image is printed on the paper P by passing through the printing nip N formed between the thermal printhead 120 and the platen roller 110.

Figure 6:
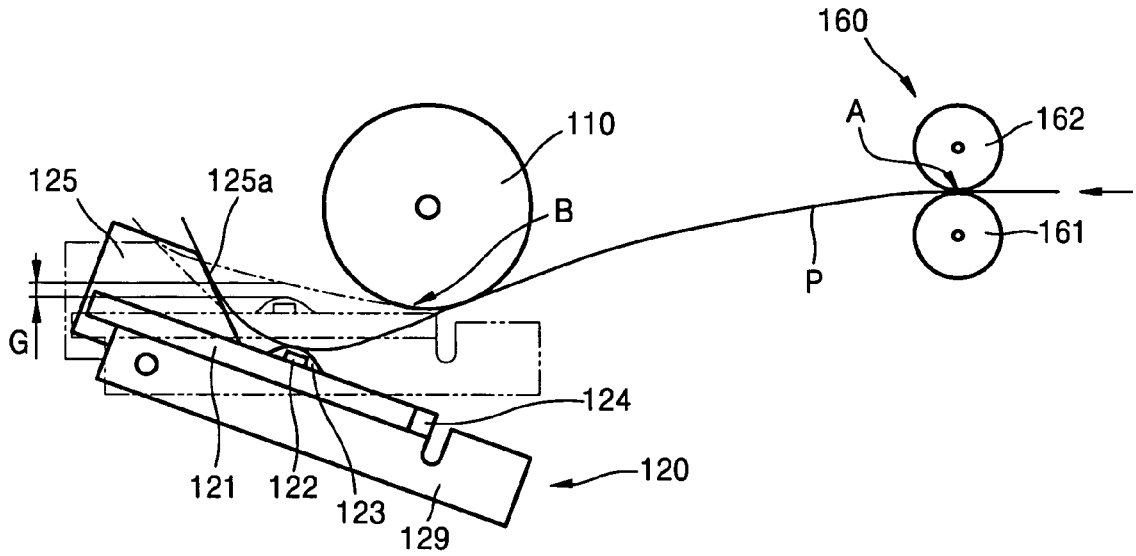
FIG. 6 is a schematic diagram illustrating a condition of the paper conveyed between the thermal printhead and the platen roller from the conveying unit illustrated in FIGS. 2 and 3 according to an exemplary embodiment of the present invention.

Referring to FIG. 6, when the paper P is conveyed and supplied between the thermal printhead 120 and the platen roller 110 by the conveying unit 160, the thermal printhead 120 and the platen roller 110 are separated from each other. At this moment, the conveyance position A of the paper P passing the conveying unit 160 is not horizontal to the position B of the printing nip N (referring to FIGS. 2 and 3) formed between the platen roller 110 and the thermal printhead 120. Thus, the paper P that has passed the conveying unit 160 does not move straight towards the printing nip N, but is conveyed with its leading edge bent downwardly. Specifically, the leading edge of the paper P supplied between the platen roller 110 and the thermal printhead 120, which are separated from each other, contacts the thermal printhead 120, and is conveyed over the protruding molding portion 123 towards the block 125. The leading edge of the paper P arriving at the block 125 is smoothly guided along the side 125*a* to be conveyed over the block 125 and moved forwardly. When the paper P is being conveyed, the paper may contact the molding portion 123 covering the driving integrated circuits 122, but in an exemplary embodiment of the present invention, the paper P is not affected by the driving integrated circuits 122. This is because heat is not produced, since printing is not performed when the paper P is being supplied between the thermal printhead 120 and the platen roller 110 that are separated from each other.

The thermal printhead 120 contacts the platen roller 110 with a predetermined pressure and forms the printing nip N as illustrated with dotted lines in FIG. 6. The paper P supplied between the thermal printhead 120 and the platen roller 110 is conveyed over the block 125 and moves forwardly. Because the block 125 is higher than the molding portion 123, the paper P may be conveyed a predetermined distance G from the molding portion 123. Because the image is printed on the paper P, which is apart from the molding portion 123, a great amount of heat generated by the driving integrated circuits 122 during the printing is not transferred to the paper P, and, in particular, image deterioration, such as vertical bending on a thermal paper sheet, is substantially prevented prevented. When the height of the block 125 is too high, the block 125 may prevent the paper P from being conveyed. Thus, the block 125 may be formed such that the distance G between the paper P and the molding portion 123 is below approximately 3 mm.

Figure 1:
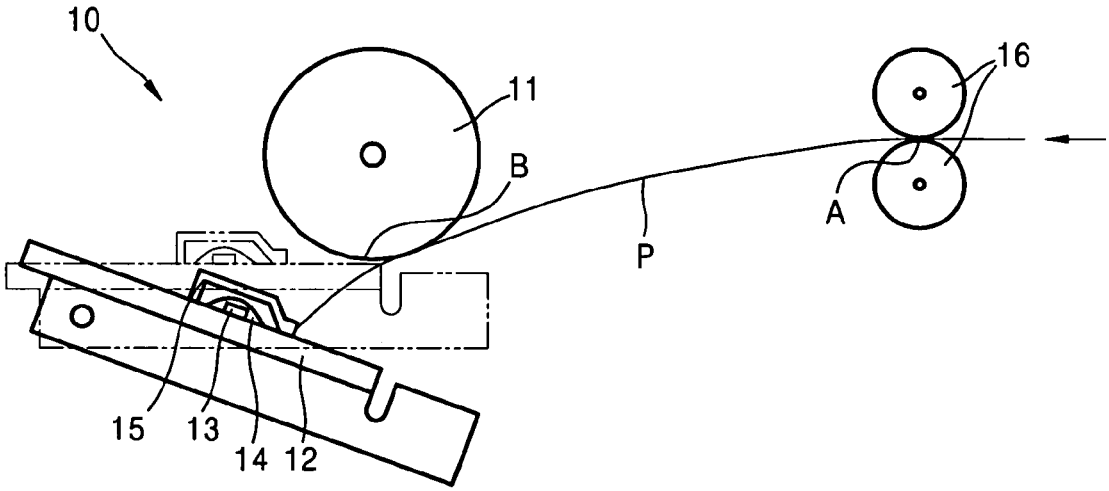
FIG. 1 (PRIOR ART)
FIG. 1 is a view illustrating a paper jam in a conventional thermal image forming apparatus.
Figure 7:
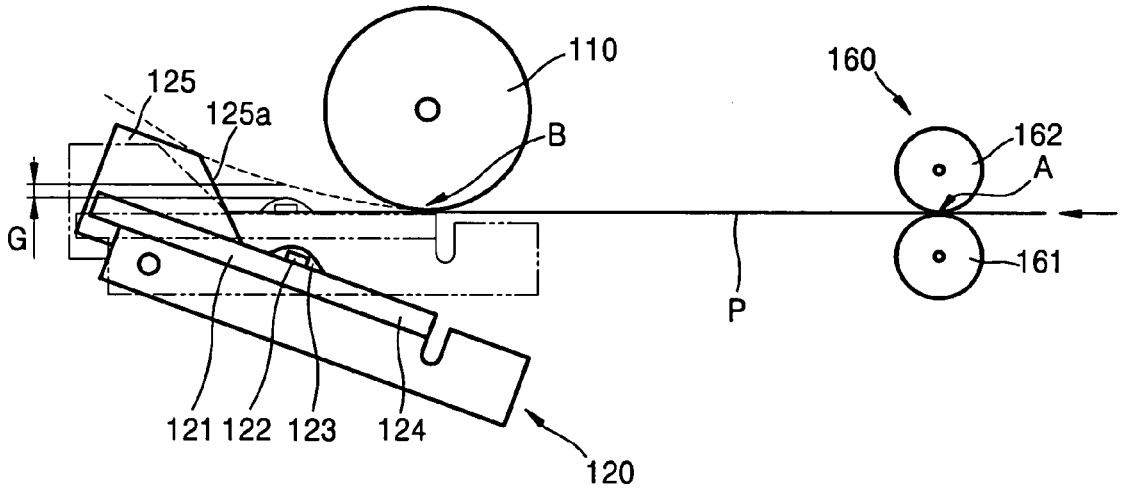
FIG. 7 is a schematic diagram illustrating another condition of the paper conveyed between the thermal printhead and the platen roller from the conveying unit illustrated in FIGS. 2 and 3 according to an exemplary embodiment of the present invention.

Referring to FIG. 7, the conveyance position A of the paper P passing the conveying unit 160 is substantially horizontal to the position B of the printing nip N formed between the platen roller 110 and the thermal printhead 120. The leading edge of the paper P that has passed the conveying unit 160 is conveyed substantially horizontally towards the printing nip N, contacts the side 125*a* of the block 125, and is guided along the incline 125*a* to be conveyed over the block 125 and moved forwardly. The thermal printhead 120 contacts the platen roller 110 with a predetermined pressure and forms the printing nip N (FIG. 1). The paper P is supplied between the thermal printhead 120 and the platen roller 110 and is conveyed over the block 125 and moved forwardly. The paper P may be conveyed a predetermined distance G from the molding portion 123. Because printing is performed in this condition, image deterioration, such as vertical bending on the paper P, especially, on a thermal paper sheet, is substantially prevented.

As described above, according to the present invention, a block is formed parallel to a plurality of driving integrated circuits to be higher than the driving integrated circuits and faces a heating portion. Thus, a sheet of paper may be prevented from contacting the driving integrated circuits, and may be smoothly conveyed without paper jams even when a conveyance position of the paper passing a conveying unit is not horizontal to a position of a printing nip formed between a platen roller and a thermal printhead. Accordingly, image deterioration and paper jams may be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal image forming apparatus, comprising:

a platen roller;

a thermal printhead including a heating portion on which a plurality of heating elements are arranged along an area where the platen roller and the thermal printhead form a printing nip;

a plurality of driving integrated circuits mounted on a substrate disposed on a side of the heating portion and connected to the heating elements of the heating portion; and a block facing the heating portion across the driving integrated circuits to guide a sheet of paper conveyed between the platen roller and the thermal printhead; and a conveying unit that conveys the sheet of paper between the platen roller and the thermal printhead to prevent the sheet of paper from interrupting and contacting the driving integrated circuits, an incline slanting in a conveying direction of the paper being formed on a side of the block facing the driving integrated circuits such that a leading edge of the inclined face of the block abuts an upper surface of the substrate.

2. The thermal image forming apparatus of claim 1, wherein the block is formed to be higher than the driving integrated circuits.

3. The thermal image forming apparatus of claim 2, wherein the block is formed such that a distance between the driving integrated circuits and the paper is less than approximately 3 mm when the driving integrated circuits and the paper are apart from each other when the paper is between the thermal printhead and the platen roller that contact each other.

4. The thermal image forming apparatus of claim 2, wherein the driving integrated circuits are covered with a molding portion.

5. The thermal image forming apparatus of claim 4, wherein the block is formed higher than the molding portion.

6. The thermal image forming apparatus of claim 2, wherein the block is continuously formed to have a length corresponding to a length of the heating portion.

7. The thermal image forming apparatus of claim 2, wherein the block is divided into several pieces.

8. The thermal image forming apparatus of claim 2, wherein the block is partially formed to correspond to the middle of the heating portion.

9. The thermal image forming apparatus of claim 2, wherein the block is connected to the substrate by inserting an edge of the substrate into the block.

10. The thermal image forming apparatus of claim 2, wherein the thermal printhead contacts the platen roller while performing a printing operation and is separated from the platen roller while the paper is conveyed.

11. The thermal image forming apparatus of claim 2, wherein the conveyance position of the paper passing the conveying unit is not horizontal to a position of the printing nip formed between the platen roller and the thermal printhead.

12. The thermal image forming apparatus of claim 2, wherein the conveyance position of the paper passing the conveying unit is substantially horizontal to a position of the printing nip formed between the platen roller and the thermal printhead.

13. The thermal image forming apparatus of claim 2, wherein the paper supplied from the conveying unit is a thermal paper having an ink layer formed on at least one side thereof.

14. The thermal image forming apparatus of claim 2, wherein a holder is installed on the other side of the thermal printhead that contacts the platen roller.

15. The thermal image forming apparatus of claim 2, wherein a paper feed cassette in which sheets of paper are stacked, a pickup roller that picks up paper from the paper feed cassette, and a discharge roller that engages the pickup roller to discharges paper, the paper feed cassette, the pickup roller and the discharge roller are installed on a side of the conveying unit opposite the thermal printhead and platen roller.

16. A thermal image forming apparatus, comprising:

a platen roller; and a thermal printhead adapted to move between a first position separated from the platen roller and a second position contacting the platen roller such that a printing nip is formed therebetween, the thermal printhead including a heating portion on which a plurality of heating elements are arranged in an area of the thermal printhead that forms the printing nip;

a plurality of driving integrated circuits mounted on a substrate connected to the heating portion and connected to the heating elements of the heating portion; and a block connected to the substrate and formed to be higher than the driving integrated circuits, an inclined surface being formed on a side of the block facing the driving integrated circuits that slants in a conveying direction of a paper conveyed between the platen roller and the thermal printhead to prevent the sheet of paper from interrupting and contacting the driving integrated circuits, a leading edge of the inclined face of the block abutting an upper surface of the substrate.

17. The thermal image forming apparatus of claim 16, wherein the conveyance position of paper passed from a conveying unit is not horizontal to a position of the printing nip formed between the platen roller and the thermal printhead.

18. The thermal image forming apparatus of claim 16, wherein a molding portion is formed to cover the driving integrated circuits such that a distance between the molding portion and paper conveyed from a conveying unit is less than approximately 3 mm when the molding portion and the conveyed paper are separated from each other when the paper is between the thermal printhead and the platen roller that are in contact with each other.

* * * * *